US007218288B2

(12) United States Patent
Kimura

(10) Patent No.: US 7,218,288 B2
(45) Date of Patent: May 15, 2007

(54) ANTENNA THAT USES FOUR METAL CONDUCTORS

(75) Inventor: Yasuko Kimura, Yokosuka (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 11/315,017

(22) Filed: Dec. 23, 2005

(65) Prior Publication Data

US 2006/0139231 A1 Jun. 29, 2006

(30) Foreign Application Priority Data

Dec. 27, 2004 (JP) ..... 2004-377008

(51) Int. Cl.
*H01Q 21/12* (2006.01)

(52) U.S. Cl. ..... 343/812; 343/808; 343/815; 343/818; 343/793

(58) Field of Classification Search ..... 343/812, 343/813, 815, 816, 817–818, 808, 793, 795
See application file for complete search history.

(56) References Cited

U.S. PATENT DOCUMENTS

| | | | | |
|---|---|---|---|---|
| 5,629,713 | A | 5/1997 | Mailandt et al. | 343/808 |
| 5,710,569 | A * | 1/1998 | Oh et al. | 343/817 |
| 6,008,773 | A | 12/1999 | Matsuoka et al. | 343/818 |
| 2003/0095076 | A1* | 5/2003 | Lee et al. | 343/837 |

FOREIGN PATENT DOCUMENTS

| | | |
|---|---|---|
| EP | 0 730 319 A1 | 9/1996 |
| JP | 5-291822 | 11/1993 |
| JP | 6-132721 | 5/1994 |
| JP | 7-3928 | 1/1995 |
| JP | 7-15232 | 1/1995 |
| JP | 2003-264426 | 9/2003 |
| JP | 2004-15365 | 1/2004 |

OTHER PUBLICATIONS

Yuki Yamaguchi, et al., "Design of a Base Station Antenna with 60° Beam Width in the Horizontal Plane for Cellular Mobile Radios", Electronics and Communications in Japan, Part I, XP-001200042, vol. 87, No. 11, 2004, pp. 68-76.

(Continued)

*Primary Examiner*—Trinh Vo Dinh
(74) *Attorney, Agent, or Firm*—Oblon, Spivak, McClelland, Maier & Neustadt, P.C.

(57) ABSTRACT

An antenna comprising a rectangular reflector; first and second dipole antennae disposed in front of the reflector and aligned parallel to the long edge of the reflector; rod-shaped first metal conductors arranged parallel to the first and second dipole antennae and separated from the dipole antennae by a distance $X_1$ to the outside in the direction parallel to the short edge of the reflector, and separated by a distance $Y_1$ in the direction perpendicular to the reflector; and rod-shaped second metal conductors disposed at a position separated from the dipole antennae by a distance $X_2$ greater than distance $X_1$ to the outside with respect to each other, and separated by a distance $Y_2$ greater than distance $Y_1$ forward in the direction perpendicular to the reflector.

1 Claim, 9 Drawing Sheets

OTHER PUBLICATIONS

Yasuko Kimura, et al., "Horizontal Pattern Control of 60-Degree Sector Antennas by Closely Arranged Conductive Poles", Technical Report of IEICE, vol. 104, No. 201, Jul. 21, 2004, pp. 37-42. (with English Abstract).

Yasuko Kimura, et al., "Control of Horizontal Radiation Pattern of Base Station Antenna for Cellular Mobile Communications by Performing Approach Arrangement of Slender Metal Conductors", Academic Journal B of IEICE, Japan, vol. J87-B, No. 5, May 1, 2004, pp. 673-684. (with English Abstract).

Mikio Iwamura, et al. "Optimal Beamwidth of Base Station Antennas for W-CDMA", 1999 General Conference of the Institute of Electronics, Information, and Communication Engineers, 4 pages.

* cited by examiner

FIG. 9A BEAM WIDTH
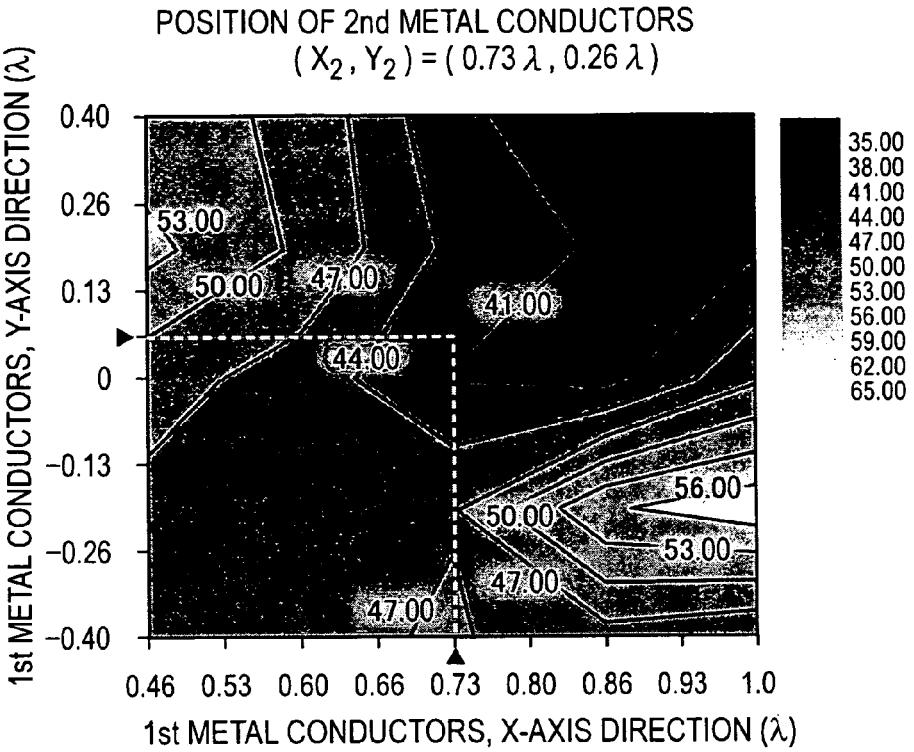
FIG. 9B FS RATIO
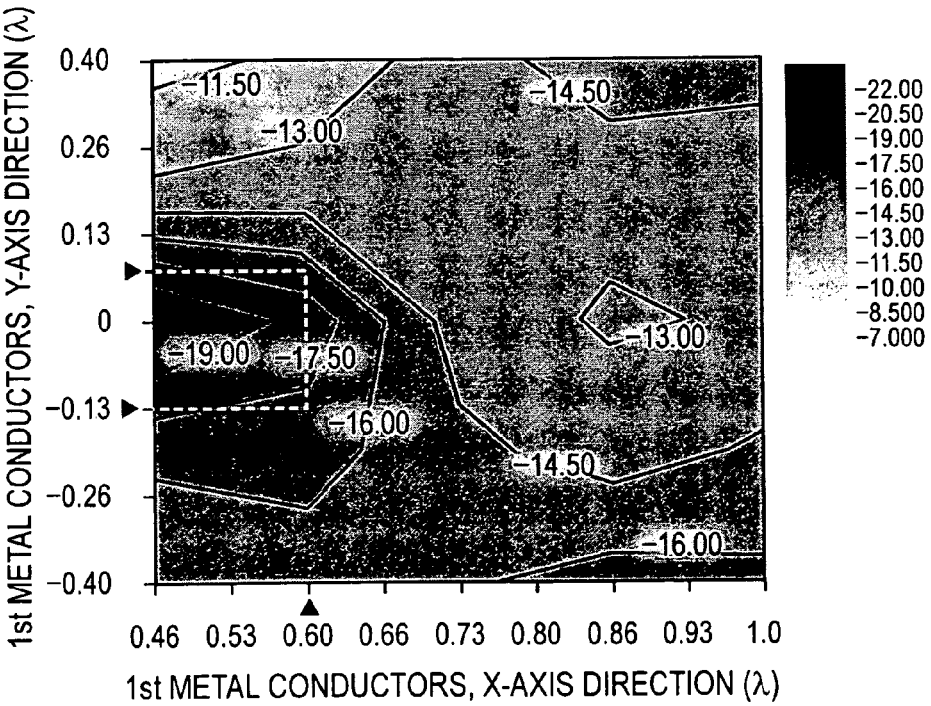

FIG. 10A BEAM WIDTH
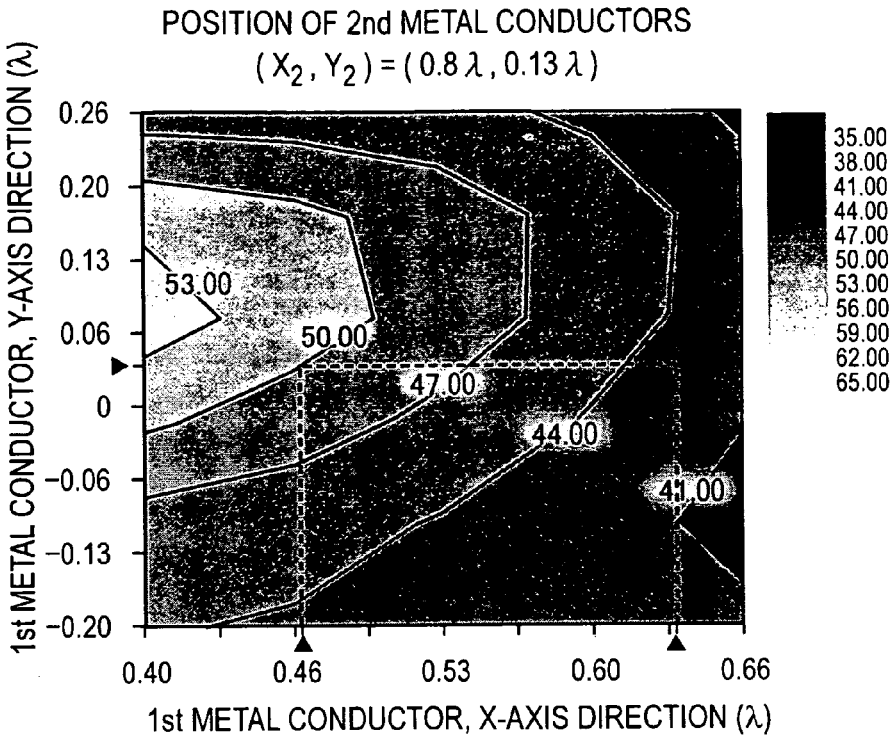
FIG. 10B FS RATIO
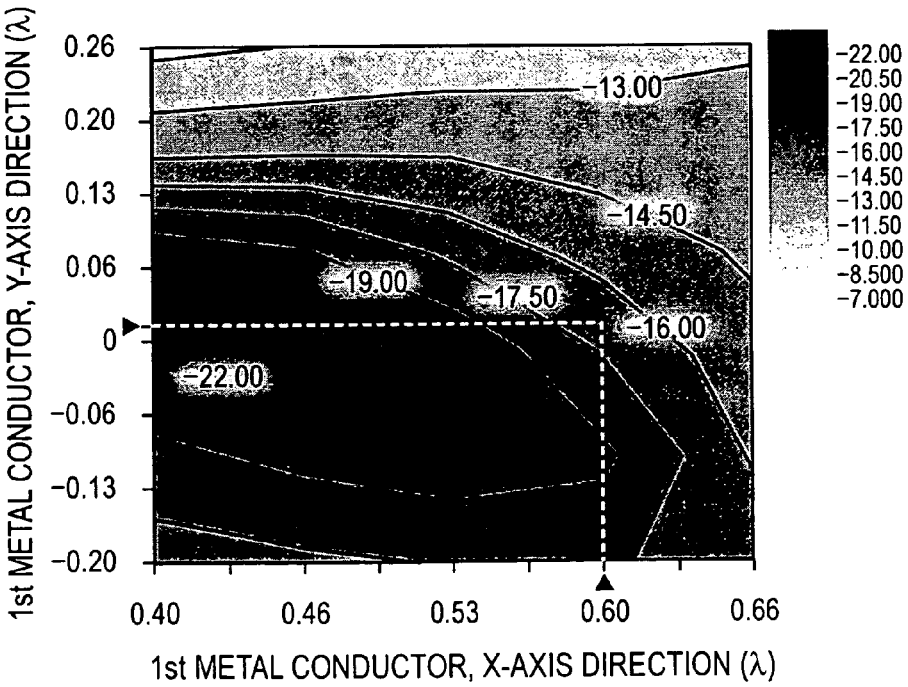

ANTENNA THAT USES FOUR METAL CONDUCTORS

BACKGROUND OF THE INVENTION

This invention relates to a small antenna having a narrow HPBW (Half-Power Beam Width) in the horizontal plane that can be adapted, for example, to a third-generation (IMT-2000 system) six-sector wireless zone. This invention more particularly relates to an antenna that uses a plurality of non-powered metal conductors and has beam characteristics in the horizontal plane that are suitable for a six-sector wireless zone.

Repeated use of the same frequency in adjacent zones is a characteristic of a third-generation system, and the service area must be divided and the number of sectors increased in order to increase subscriber capacity. It is also known that narrowing the HPBW in the horizontal plane is more effective for increasing subscriber capacity than narrowing the angle of sector division (Reference: "Optimal Beamwidth of Base Station Antennas for W-CDMA" 1999 General Conference of The Institute of Electronics, Information, and Communication Engineers). In a six-sector wireless zone, since the division angle of one sector is 60°, an antenna having a HPBW in the horizontal plane that is narrower than 60° is needed in order to increase subscriber capacity.

Generally known methods for narrowing the HPBW in the horizontal plane involve enlarging the reflecting device. FIG. 11 shows an antenna in which the HPBW in the horizontal plane is set to 45° by a dipole antenna and a planar reflector. Dipole antennae 111 and 112 are arranged parallel to and in front of the planar reflector 110. The aperture width of the planar reflector 110 for making the HPBW 45° in the horizontal plane is 150 mm as found by a moment method when the central frequency used is 2 GHz, for example, and a length of one wavelength $\lambda_{2G}$ of 2 GHz is necessary.

By another well known method, the same effect as widening the antenna aperture width is obtained by placing a metal conductor near the antenna, and inducing an electric current in the metal conductor. FIG. 12 shows a 60° beam antenna in which metal conductors are placed on both sides of the antenna, and the HPBW in the horizontal plane is set to 45°. The dipole antennae 121 and 122 in front of the reflector 120 are arranged opposite each other and parallel to the planar reflector 120. Metal conductors 123 and 124 substantially equal in length to the reflector 120 in the longitudinal direction are arranged parallel to the dipole antennae 121 and 122 at a wider spacing than the spacing between the dipole antennae 121 and 122. These metal conductors 123 and 124 produce the same effect as widening the reflector 110 shown in FIG. 11, and the HPBW in the horizontal plane is set to 45°.

Another example described in Japanese Patent Application Laid Open No. 2004-15365 that uses a metal conductor is shown in FIG. 14. In the example shown in FIG. 14, a first metal wire 142 substantially equal in length to the radome of a multi-frequency common 120° beam antenna 140 is placed in a position at a distance $S_1$ from the center of the beam antenna 140 in the direction ±90° with respect to the main radiation direction of the antenna 140, a second metal wire 143 shorter than the first metal wire 142 is placed in a position at a distance $S_2$ nearer than distance $S_1$ in the same direction, and the HPBW is narrowed to 90°.

The method for enlarging the reflecting device shown in FIG. 11 has drawbacks in that the already installed antenna is unusable. This, of course, necessitates replacing the antenna, which makes interruption of service unavoidable and places a burden on the user. When the reflecting device is enlarged, since the surface area blown by wind increases and the strength of the building material becomes an issue when the antenna is mounted on the rooftop of a building or the like, it may become impossible to install a desired antenna in some cases. Methods for enlarging the reflecting device therefore involve significant burdens both in service and economic aspects.

The method shown in FIG. 12 whereby the metal conductors 123, 124 are placed near the antenna has advantages in that the existing antenna can be used. However, the conventional method has drawbacks in that the back lobe level and side lobe levels increase when the HPBW is narrowed.

The solid line in FIG. 13 indicates the directional characteristics in the horizontal plane of the antenna shown in FIG. 12 in which the HPBW is narrowed using metal conductors. In FIG. 13, the angle of the main radiation direction of the antenna is set to 90°, and the axis scale is normalized so that the maximum value is 0 dB. The half bandwidth (−3 dB) for when the metal conductors 123, 124 of FIG. 12 are not present, indicated by the dashed line in FIG. 13, is 60°, but the half bandwidth is indeed 45°, as shown in FIG. 13, due to the effect of placing the metal conductors. However, the back lobe in the direction of 270° is increased by about 3 dB. The antenna gain in the 30° and 150° directions offset 60° from the main radiation direction is also at a level of about −13 dB, and lowering the gain of the back lobe and side lobes in order to decrease interference is desirable when the original purpose is considered, which is to increase the subscriber capacity by reducing interference to narrow the HPBW. It can hardly be said that adequate directional characteristics in the horizontal plane are obtained by conventional methods that use a metal conductor in this manner.

SUMMARY OF THE INVENTION

This invention was developed in view of the foregoing drawbacks, and an object thereof is to provide an antenna in which a HPBW of 45° is obtained in an existing antenna having a HPBW of 60° in the horizontal plane, and in which the side lobes and back lobe are reduced.

This invention comprises a rectangular reflector; first and second dipole antennae disposed in front of the reflector and aligned parallel to the long edge of the reflector; rod-shaped first metal conductors arranged parallel to the first and second dipole antennae and separated from the dipole antennae by a distance $X_1$ to the outside in the direction parallel to the short edge of the reflector, and separated by a distance $Y_1$ forward in the direction perpendicular to the reflector; and rod-shaped second metal conductors arranged parallel to the first and second dipole antennae and separated from the dipole antennae by a distance $X_2$ greater than distance $X_1$ to the outside with respect to each other in the direction parallel to the short edge of the reflector, and separated by a distance $Y_2$ greater than distance $Y_1$ forward in the direction perpendicular to the reflector.

By this configuration, an antenna can be provided whereby a HPBW of 45° can be obtained in an existing antenna having a HPBW of 60° in the horizontal plane, and in which the side lobes and back lobe are reduced.

BRIEF DESCRIPTION OF THE DRAWINGS

FIG. 9A is a diagram showing the results of calculating the change in the HPBW in the horizontal plane when the position of the first metal conductor is varied in a state in which the position of the second metal conductor is fixed at $X_2$=0.73 λ and $Y_2$=0.26 λ;

FIG. 9B is a diagram showing the results of calculating the change in the FS ratio under the same conditions as in FIG. 9A;

FIG. 10A is a diagram showing the results of calculating the change in HPBW in the horizontal plane when the position of the first metal conductor is varied in a state in which the position of the second metal conductor is fixed at $X_2$=0.8 λ and $Y_2$=0.13 λ;

FIG. 10B is a diagram showing the results of calculating the change in the FS ratio under the same conditions as in FIG. 10A;

DESCRIPTION OF THE PREFERRED EMBODIMENTS

Embodiments of this invention will be described hereinafter with reference to the drawings.

Figure 1A:
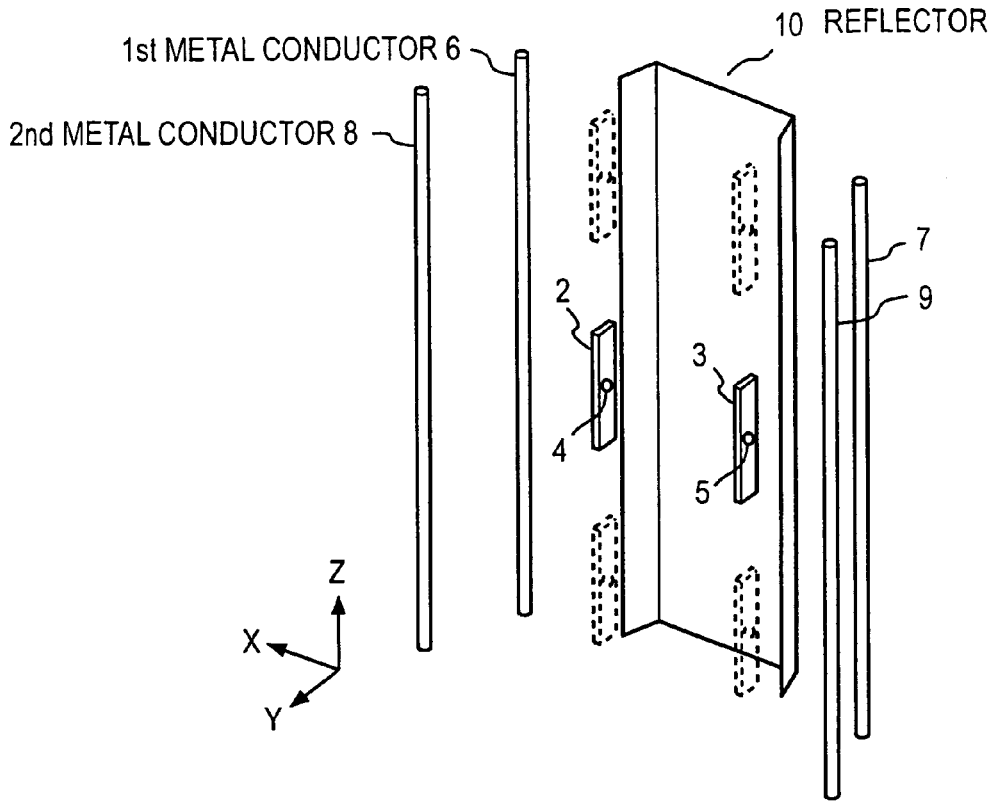
FIG. 1A is a perspective view showing the antenna of this invention in which four metal conductors are used.
Figure 1B:
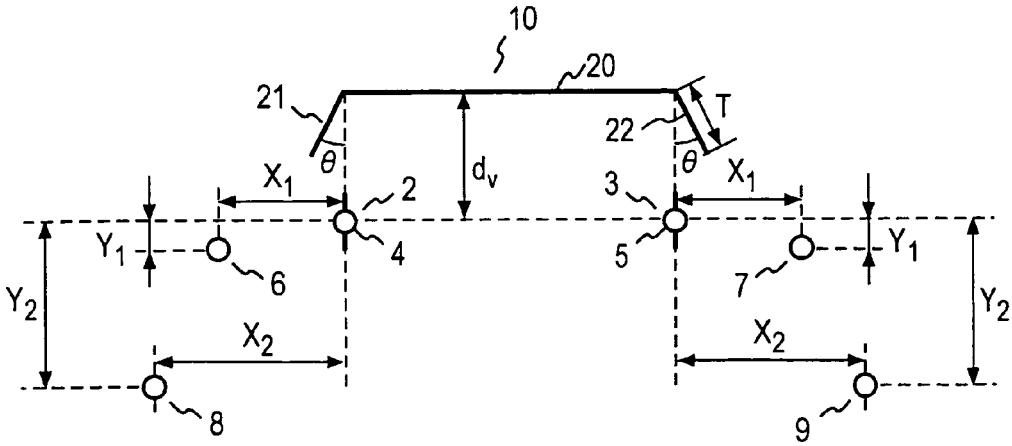
FIG. 1B is a plan view of the antenna shown in FIG. 1A.

The antenna of this invention that uses four metal conductors is shown in FIG. 1. A perspective view thereof is shown in FIG. 1A, and a plan view thereof is shown in FIG. 1B. A first dipole antenna 2 and a second dipole antenna 3 are placed parallel to each other in front of a rectangular plate-shaped reflector 10, and parallel (Z-axis) to the long edge of the reflector 10. Arranged parallel to the first and second dipole antennae 2 and 3 are rod-shaped first metal conductors 6 and 7 separated from the dipole antennae by a distance $X_1$ to the outside in the direction parallel (X-axis) to the short edge of the reflector 10, and a distance $Y_1$ in the direction perpendicular (Y-axis) to the reflector 10. Also arranged parallel to the first and second dipole antenna 2 and 3 are rod-shaped second metal conductors 8 and 9 separated from the dipole antennae by a distance $X_2$ greater than distance $X_1$ to the outside with respect to each other in the direction parallel to the short edge of the reflector 10 and a distance $Y_2$ in the direction perpendicular to the reflector 10. The reference numerals 4 and 5 in the center portions of the first dipole antenna 2 and second dipole antenna 3 indicate power feed points. The first and second dipole antennae 2 and 3 have a rectangular plate shape in the example shown in FIG. 1A, but these antennae may also be rod-shaped.

[Structure of the Reflector and Dipole Antennae]

Figure 2A:
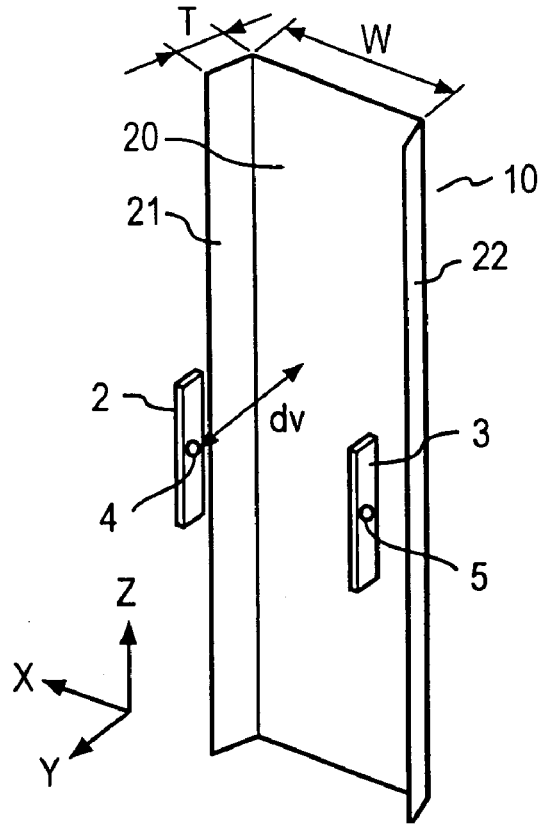
FIG. 2A is a perspective view showing the 60° beam antenna that is the basis of this invention.
Figure 2B:
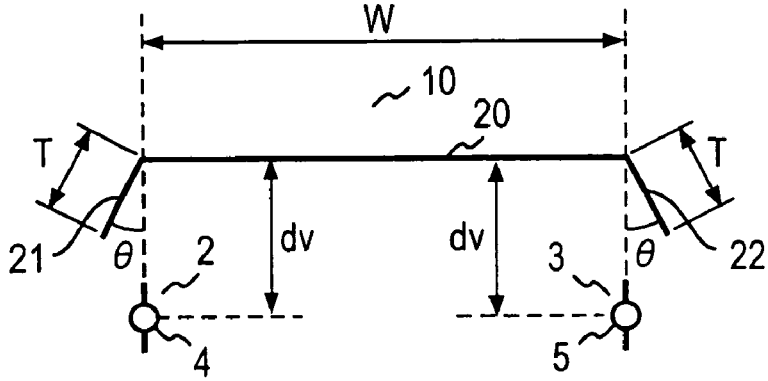
FIG. 2B is a plan view of the antenna shown in FIG. 2A.

First, the 60° beam antenna that forms the basis of the 45° beam antenna of the present invention is shown in FIG. 2, which shows the specific structure of the reflector and the first and second dipole antennae. A perspective view of the 60° beam antenna that forms the basis of the present invention is shown in FIG. 2A, and a plan view thereof is shown in FIG. 2B. The reflector 10 has a rectangular plate-shaped main reflector 20 and first and second side reflectors 21 and 22 bent forward and extended from the edges on both sides of the main reflector 20. The length of the long edge of the main reflector 20 is greater than the length of the first and second dipole antennae 2 and 3. The first and second dipole antennae, separated by a distance $d_v$ forward from the edges on both sides of the main reflector 20, are arranged parallel to the side edges of the main reflector 20. For convenience in this description, W is used to indicate the length of the short edge of the main reflector 20, θ is used to indicate the opening angle in the forward direction from both ends of the main reflector 20, and T is used to indicate the length in the elongation direction of the first and second side reflectors 21 and 22.

[Width W of the Main Reflector]

Figure 3:
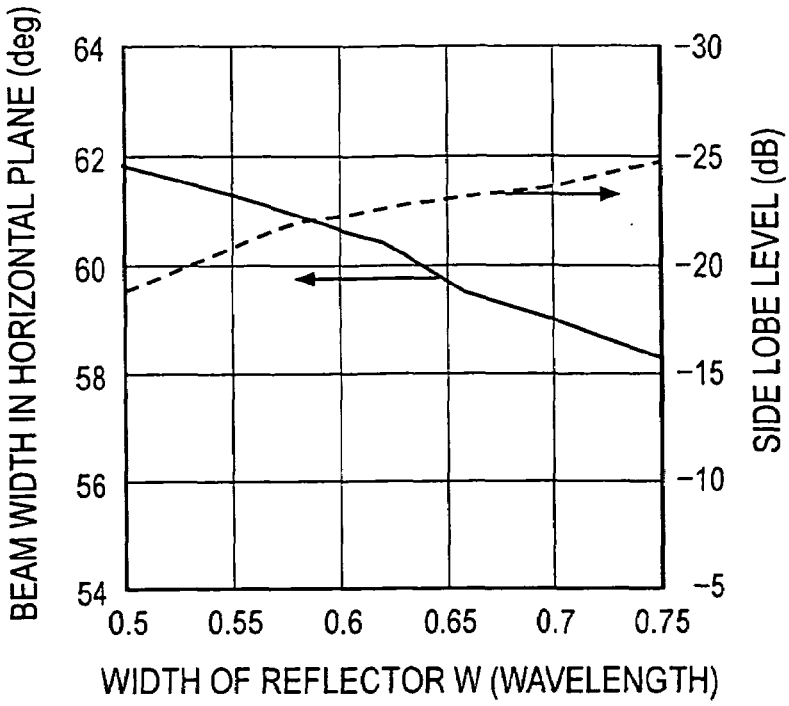
FIG. 3 is a diagram showing the relationship among the width W of the main reflector, the HPBW in the horizontal plane, and the side lobes.

FIG. 3 is a diagram showing the relationship among the width W of the main reflector 20, the HPBW in the horizontal plane, and the side lobes. The width W of the main reflector 20 is indicated in the horizontal axis by the wavelength equivalent value when the central frequency used is 2.0 GHz. The vertical axis on the left side shows the HPBW (degrees) in the horizontal plane, and the vertical axis on the right side shows the level (dB) of the side lobes. The HPBW in the horizontal plane when the width W of the main reflector 20 is varied from 0.5 λ to 0.75 λ is indicated by the solid line, and the side lobe level is indicated by the dashed line.

As the width W of the main reflector 20 is increased, the HPBW in the horizontal plane narrows in nearly inverse proportion to W. Characteristics are shown in which a HPBW that is about 61.8° when the width W of the main reflector 20 is 0.5 λ narrows in nearly linear fashion to a HPBW of about 58.4° when W=0.75 λ. When the length of the short edge of the reflector is increased in this manner, the HPBW becomes narrow. This relationship was also described in the prior art section.

In the same manner as the HPBW in the horizontal plane, the side lobes are also in a relationship whereby the level thereof decreases in inverse proportion to an increase in the width W of the main reflector 20. The level of the side lobes decreases as the width W of the reflector 10 is increased, but the diagram of the side lobe level is shown as to ascend toward the right side for convenience.

Thus, the more the width W of the main reflector is increased, the further the HPBW in the horizontal plane can be narrowed. However, such drawbacks as those described previously as drawbacks to be overcome by the present invention occur when the width W of the main reflector is simply increased. Therefore, a width W of 0.66 λ (wavelength equivalent values in the dimensions according to the embodiments below are shown rounded to three decimal places or less) is used for the main reflector 20 in this embodiment.

[Length T of the Side Reflectors]

Figure 4:
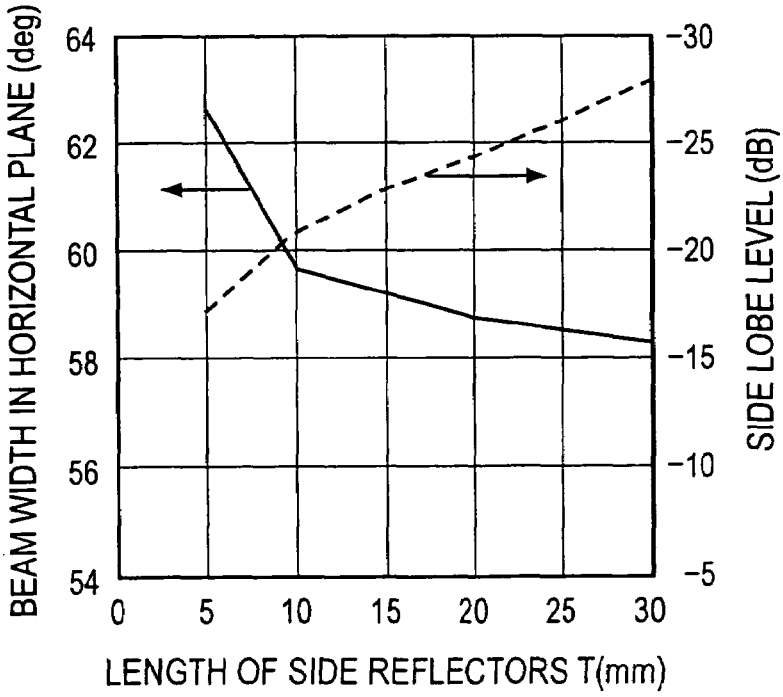
FIG. 4 is a diagram showing the relationship among the length T of the side reflector in the elongation direction, the HPBW in the horizontal plane, and the side lobes.

The relationship among the length T in the elongation direction of the side reflectors 21 and 22, the HPBW in the horizontal plane, and the side lobes is shown in FIG. 4. The horizontal axis indicates the length T of the side reflectors in the elongation direction. Since the value of the length T is too small when indicated as a wavelength equivalent, it is shown in millimeter units herein. The vertical axis on the left side shows the HPBW (degrees) in the horizontal plane, and the vertical axis on the right side shows the level (dB) of the side lobes. The HPBW in the horizontal plane when the length T of the side reflectors 21 and 22 in the elongation direction is varied from 5 to 30 mm is indicated by the solid line, and the side lobe level is indicated by the dashed line. These data are for a case in which the width W of the main reflector 20 is 0.75 λ.

The HPBW in the horizontal plane is about 62.5° when the length T is 5 mm, and the HPBW abruptly narrows to about 59.8° when the length T is increased to 10 mm. The change in the HPBW is then gradual as the length T is increased, and the characteristics indicate that the HPBW of about 59.8° changes to 58.4° in a generally inverse proportional relation to an increase in the length T of up to 30 mm. The side lobe characteristics also show slightly different slopes in the ranges of 5 to 10 mm and 10 to 30 mm for the length T of the side reflectors 21 and 22, but the level thereof generally decreases in linear fashion as the length T increases.

By increasing the length T of the side reflectors 21 and 22 in the elongation direction in this manner, a narrower HPBW in the horizontal plane can be obtained. The length T of the side reflectors 21 and 22 in the elongation direction was 20 mm in this embodiment, which corresponds to T=0.13 λ in terms of wavelength.

[Angle θ of Side Reflectors]

Figure 5:
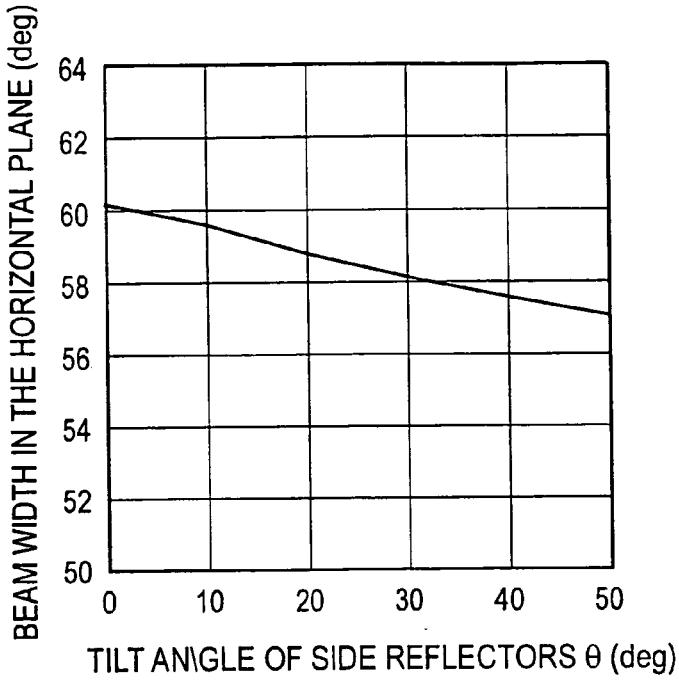
FIG. 5 is a diagram showing the relationship between the HPBW in the horizontal plane and the angle at which the first and second side reflectors open in the forward direction from both ends of the main reflector.

FIG. 5 shows the relationship between the HPBW in the horizontal plane and the angle θ at which the first and second side reflectors 21 and 22 open with respect to the forward direction from both ends of the main reflector 20. The angle θ (degrees) is indicated by the horizontal axis, and the HPBW (degrees) in the horizontal plane is indicated by the vertical axis. When the angle θ is 0°; specifically, when the side reflectors 21 and 22 extend in the forward direction at right angles to the main reflector 20 from both ends of the main reflector 20, the HPBW in the horizontal plane is about 60.3°, and the HPBW is 57.3° when the angle θ is 50°. In this interval, characteristics are shown whereby the HPBW narrows in nearly linear fashion with respect to an increase in the angle θ. As the angle θ is increased in this manner, since the short edge which forms the forward projecting surface area as viewed from the front of the reflector 10 is lengthened, the same effects are obtained as when the width of the main reflector 20 is increased. The angle θ was set to 20° in this embodiment.

In another configuration, the distance $d_v$ between the main reflector 10 and the power feed points 4 and 5 is set to 0.25 λ.

[Directional characteristics in the Horizontal Plane in this Embodiment]

First metal conductors 6 and 7 and second metal conductors 8 and 9 were provided in this embodiment to the antenna shown in FIG. 2.

Figure 6:
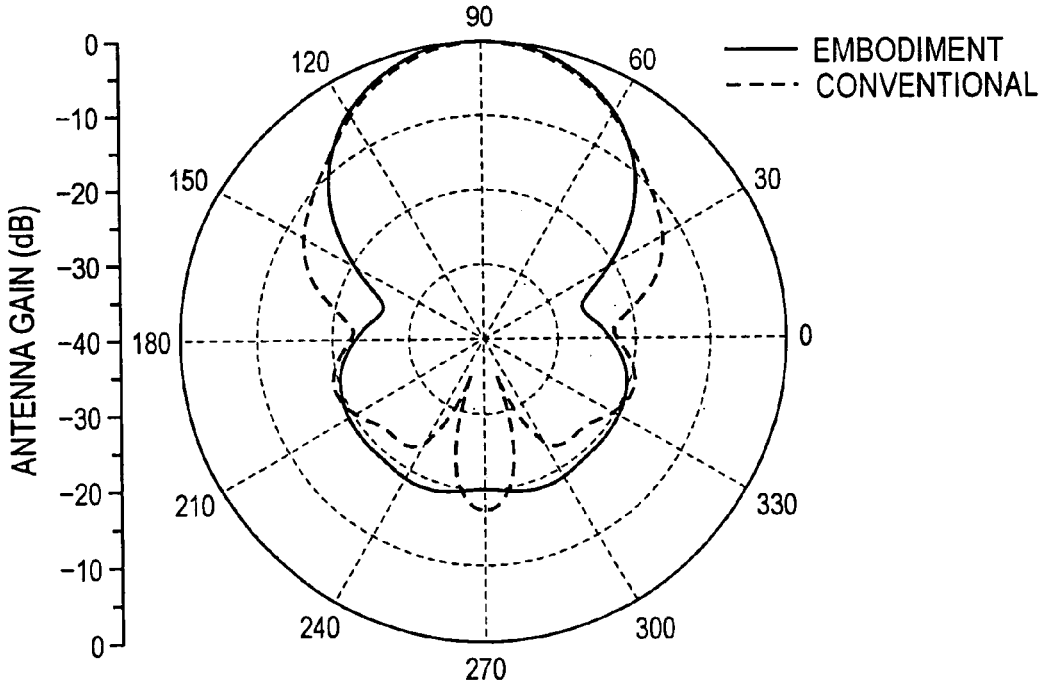
FIG. 6 is a diagram showing the directional characteristics in the horizontal plane of the antenna of this example.

The directional characteristics in the horizontal plane are shown in FIG. 6 for the antenna of this embodiment in which W=0.66 λ, $d_v$=0.25 λ, T=0.13 λ, θ=20°, $X_1$=0.6 λ, $Y_1$=−0.13 λ, $X_2$=0.73 λ, and $Y_2$=0.26 λ. In FIG. 6, the angle of the main radiation direction of the antenna is 90°, and the radius is expressed in terms of the antenna gain, which is −40 dB in the center and 0 dB at the periphery. The directional characteristics in the horizontal plane of this embodiment are indicated by the solid line, and the directional characteristics in the horizontal plane of the conventional 45° beam antenna described in the prior art section are indicated by the dashed line.

The solid line and the dashed line both show the realization of a 45° beam antenna. However, the antenna gain is high on the outside beyond 90° ±45° in the conventional antenna indicated by the dashed line. In contrast with the characteristics of the prior art indicated by the dashed line, the antenna gain in the range of ±40° to ±90° with respect to the main beam direction (90°) in this embodiment, which is indicated by the solid line, is less than that of the prior art indicated by the dashed line. The antenna gain particularly in the angle of ±60°, which was about −13 dB in the conventional antenna, is about −20 dB, which shows a significant improvement. In other words, the side lobe gain is reduced. The 270° direction opposite the main beam direction, specifically, the back lobe level, is improved by about 3 dB to about −20 dB with respect to the −17 dB of the prior art.

By arranging the first metal conductors 6 and 7 and the second metal conductors 8 and 9 in this manner, the beam can be narrowed, and the side lobes and back lobe can also be reduced. These changes in characteristics contribute to increased subscriber capacity.

[Length of First and Second Metal Conductors]

Figure 7:
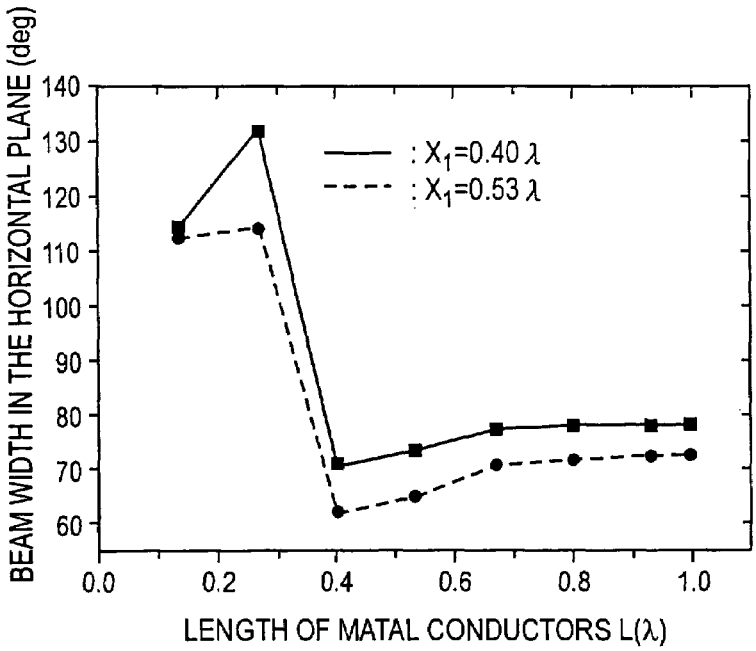
FIG. 7 is a diagram showing the relationship between the length of the first and second metal conductors and the HPBW in the horizontal plane.
Figure 12:
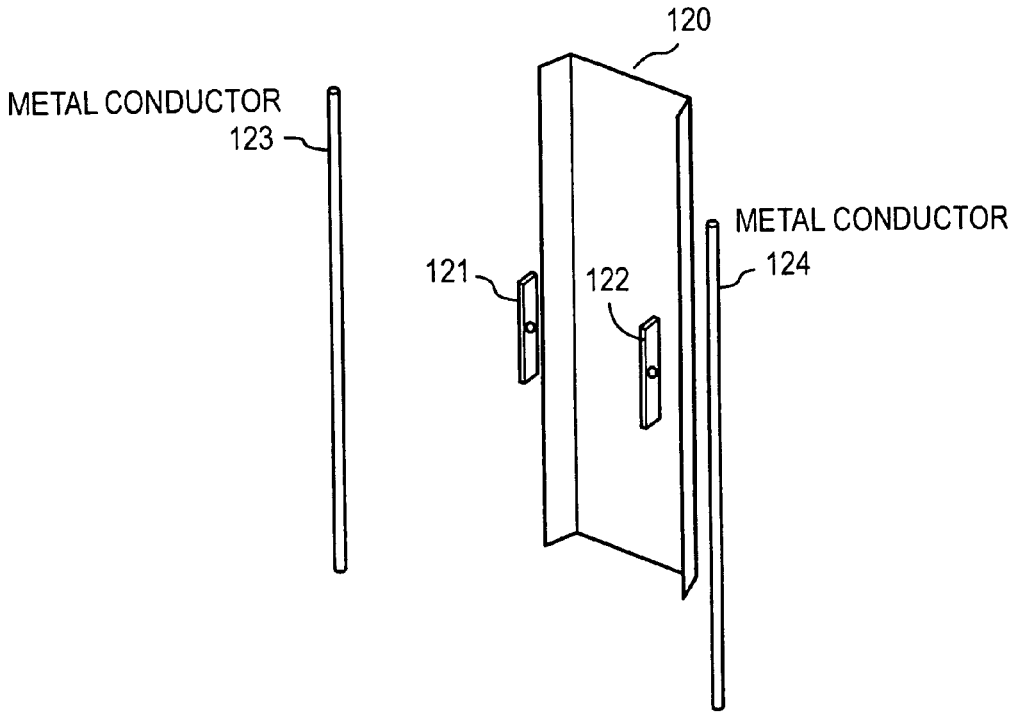
FIG. 12 is a diagram showing a 60° beam antenna in which metal conductors are placed on both sides of the antenna, and the HPBW in the horizontal plane is set to 45°.
Figure 13:
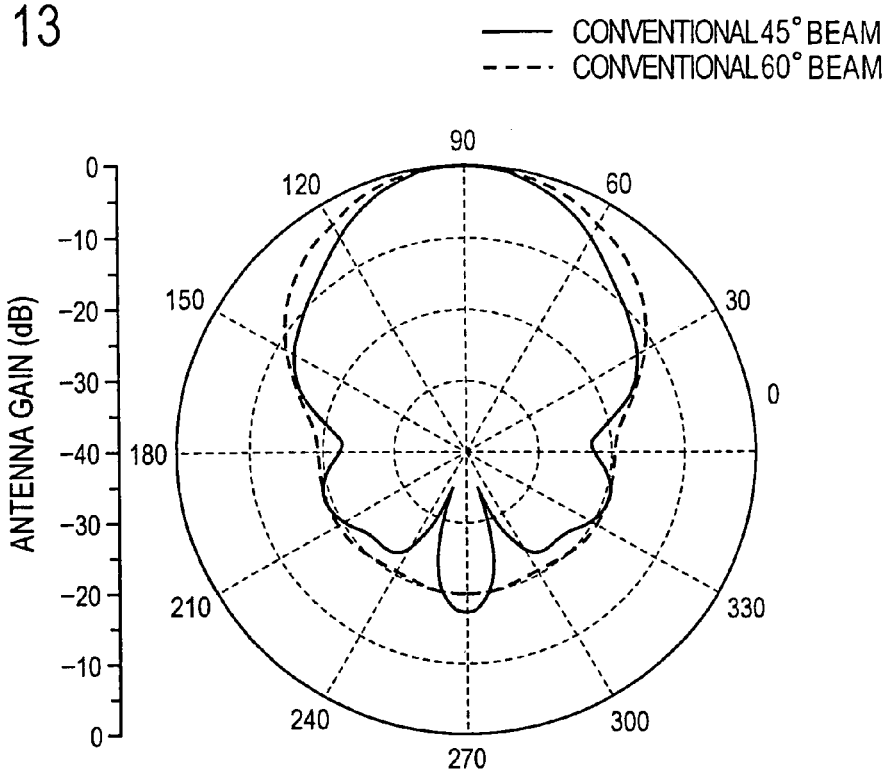
FIG. 13 is a diagram showing the directional characteristics in the horizontal plane of the antenna shown in FIG. 12 that uses metal conductors.
Figure 14:
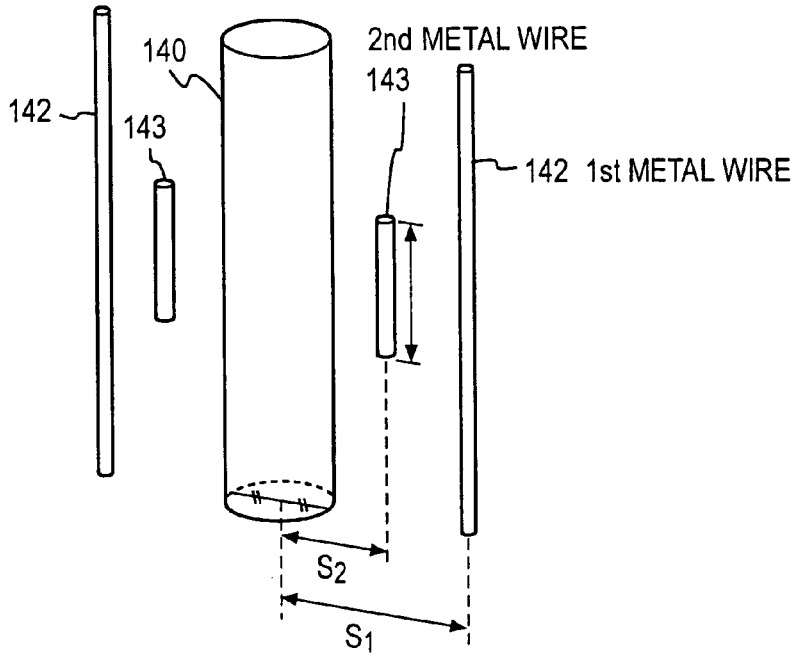
FIG. 14 is a diagram showing an example of the prior art that uses metal conductors.

FIG. 7 shows the relationship between the length of the metal conductors and the HPBW in the horizontal plane. This diagram shows the calculated result when metal conductors 123 and 124 such as the ones shown in FIG. 12 are attached to a 120° beam antenna on the left and right, respectively, with respect to the main beam direction. The length L of the first and second metal conductors 6 and 7 is indicated on the horizontal axis as a wavelength-equivalent value when the central frequency used is 2.0 GHz, and the HPBW in the horizontal plane when the length L is varied from 0.13 λ to 1.0 λ is indicated in degrees on the vertical axis. The solid line in FIG. 7 shows a case in which the distance $X_1$ between the dipole antennae and the metal conductors is 0.4 λ, and the dashed line shows a case in which the distance $X_1$ is 0.53 λ and the distance $Y_1$ is 0.

When the length L ranges from 0.13 λ to 0.27 λ, the characteristics are such that the HPBW in the horizontal plane increases as the length L is increased, but the HPBW then rapidly decreases when the length L is 0.4 λ. The HPBW that is about 132° when the length L is 0.27 λ narrows to about 71° when the length L is 0.4 λ in the characteristics indicated by the solid line ($X_1$=0.40 λ). The HPBW then tends to gradually widen as the length L increases, and becomes about 78° when the length L is 1.0 λ.

This tendency is the same even when the distance $X_1$ from the dipole antennae changes to 0.53 λ, as indicated by the dashed line. The effects obtained are therefore considered to be fixed as long as the length of the first and second metal conductors 6 and 7 is 0.4 λ or greater.

Therefore, in this embodiment, the length of the first and second metal conductors 6 and 7 is made greater than the length of the first and second dipole antennae 2 and 3 and nearly equal to the length of the long edge of the reflector 10.

[Diameter of First and Second Metal Conductors]

Figure 8:
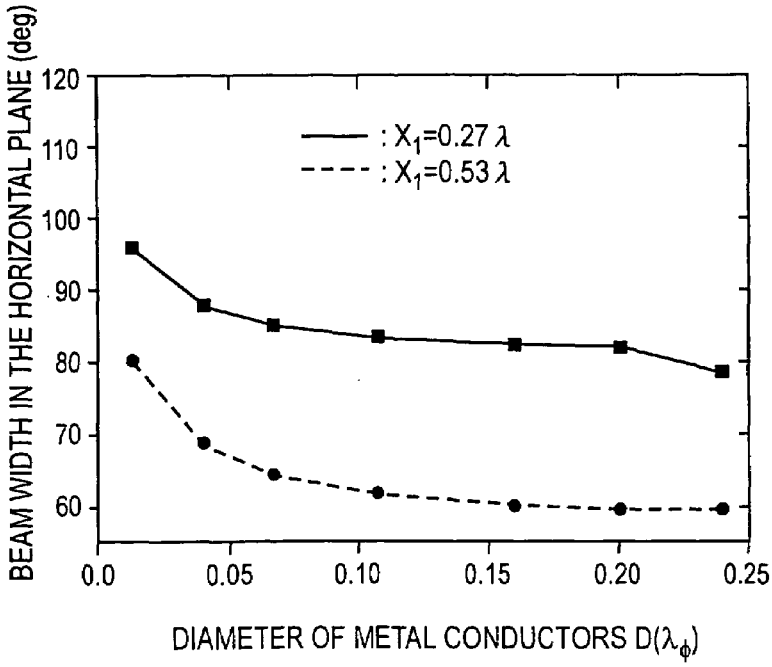
FIG. 8 is a diagram showing the relationship between the diameter of the first and second metal conductors and the HPBW in the horizontal plane.
Figure 11:
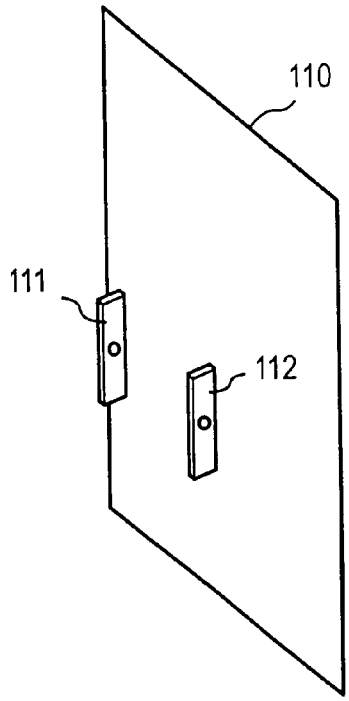
FIG. 11 is a diagram showing an antenna in which the HPBW in the horizontal plane is set to 45° by dipole antennae and a planar reflector.

FIG. 8 shows the relationship between the HPBW in the horizontal plane and the diameter of the metal conductors. This diagram shows the calculated result when metal conductors 123 and 124 such as the ones shown in FIG. 12 are attached to a 120° beam antenna on the left and right, respectively, with respect to the main beam direction. The diameter D of the metal conductors 123 and 124 is indicated on the horizontal axis as a wavelength-equivalent value when the central frequency used is 2.0 GHz, and the HPBW in the horizontal plane when the diameter D is varied from 0.01 λ to 0.24 λ is indicated in degrees on the vertical axis. The solid line shows a case in which the distance between the dipole antennae and the metal conductors is 0.27 λ, and the dashed line shows a case in which this distance is 0.53 λ.

When the diameter D ranges from 0.01 λ to 0.24 λ, the characteristics are such that the HPBW in the horizontal plane gradually narrows as the diameter D is increased. The HPBW that is about 96° when the diameter D is 0.01 λ narrows to about 79° when the diameter D is 0.24 λ in the characteristics indicated by the solid line. This tendency is the same even when the distance from the dipole antennae to the metal conductors is changed from 0.27 λ to 0.53 λ.

There is little change in the HPBW in the horizontal plane when the diameter D is 0.05 λ or greater. Since the surface area blown by wind decreases as the metal conductors are made narrower, the diameter D was set to 0.04 λ in this embodiment.

[Position of First and Second Metal Conductors]

In order to find the optimum position for the first and second metal conductors, the position of the first metal conductors 6 and 7 was varied while the position of the second metal conductors 8 and 9 was fixed, and the changes in the FS ratio and the HPBW in the horizontal plane were calculated by a moment method.

The results of calculating the changes in the FS ratio and the HPBW in the horizontal plane when the position of the first metal conductors 6 and 7 was varied with the position of the second metal conductors 8 and 9 fixed at $X_2$=0.73 λ and $Y_2$=0.26 λ are indicated by grayscale shading in FIGS. 9A and 9B. The number above the solid line in the center of FIG. 9A indicates the HPBW on that line. The distance in the X-axis direction of the first metal conductors on the horizontal axis and the distance in the Y-axis direction on the vertical axis are indicated as wavelength equivalent values when the central frequency used is 2.0 GHz.

Since a HPBW of 45° is the aim, the range of 40° to 50° as found from FIG. 9A is the area indicated by the dashed line in an X range of 0.46 λ to 0.73 λ and a Y range of −0.4 λ to about 0.06 λ.

The FS ratio (ratio of front and side antenna gain) in the same conditions is shown in FIG. 9B. FIG. 9B is a grayscale shading diagram showing the worst value of the FS ratio in the range of 180 to 0° when the main beam direction is set to 90°. The area in which the FS ratio is −17 dB or less as found from FIG. 9B is the area indicated by the dashed line in an X range of 0.46 λ to 0.6 λ and a Y range of −0.13 λ to about 0.08 λ.

When the FS ratio is −15 dB or less, for example, the X range widens to 0.46 λ to 0.7 λ, and the Y range narrows somewhat to −0.13 λ to about 0.02 λ.

The position to be used for the first metal conductors 6 and 7 thus changes according to the HPBW and the magnitude of the FS value, but when the FS value is −17 dB or less, the $X_1$ range is 0.46 λ to 0.6 λ, and the $Y_1$ range is −0.13 λ to 0.06 λ.

Of particular note here is the fact that the relationship among the distance, the HPBW, and the FS ratio is not a monotonic, one-way relationship. An area in which the HPBW is 47 to 50° suddenly occurs in FIG. 9A when X=0.69 λ to 0.75 λ. In FIG. 9B, an area of −13 dB suddenly occurs in the position where X=0.86 λ and Y=0 λ. This non-monotonic relationship first became apparent as a result of the present study, and had not been anticipated. The aforementioned ranges for $X_1$ and $Y_1$ are based on research results.

The results of calculating the change in the FS ratio and the HPBW in the horizontal plane when the position of the first metal conductors 6 and 7 was varied with the position of the second metal conductors 8 and 9 fixed at $X_2$=0.8 λ and $Y_2$=0.13 λ are indicated by grayscale shading in FIGS. 10A and 10B, in the same manner as in FIGS. 9A and 9B. Since a HPBW of 45° is the aim, the range of 40° to 50° as found from FIG. 10A is the area indicated by the dashed line in an X range of about 0.46 λ to 0.63 λ and a Y range of −0.2 λ to about 0.03 λ.

The FS ratio (ratio of front and side antenna gain) in the same conditions is shown in FIG. 10B. The area in which the FS ratio is −17 dB or less as found from FIG. 10B is the area indicated by the dashed line in an X range of 0.4 λ to 0.6 λ and a Y range of −0.2 λ to about 0.01 λ.

When the FS ratio is −15 dB or less, for example, the X range is 0.4 λ to about 0.64 λ, and the Y range is −0.2 λ to about 0.06 λ.

Based on the results shown in FIGS. 9A, 9B, 10A, and 10B, it was learned that in order to bring the HPBW in the horizontal plane to 45° and the FS ratio to −17 dB or less, the position of the first metal conductors 6 and 7 should be set so that $X_1$=0.46 λ to 0.6 λ and $Y_1$=−0.13 λ to 0.01 λ, and the position of the second metal conductors should be set so that $X_2$=0.73 λ to 0.8 λ and $Y_2$=0.13 λ to 0.26 λ.

As described above, it becomes possible to minimize the side beam and back lobe levels while narrowing the beam width by arranging a total of four metal conductors so that two conductors each are on the left and right of the antenna reflector.

According to this embodiment, a HPBW of 45° was obtained when the width W of the main reflector 20 in the short-edge direction thereof was 0.66 λ. This configuration produces about 30% or greater reduction of air resistance compared to the conventional method in which the HPBW is narrowed simply by extending the short-edge length of the reflector. The length of the main reflector in the long-edge direction is not an issue here because the antenna is arrayed in the long-edge direction of the reflector according to the desired antenna gain. In order to increase the antenna gain, the number of dipole antenna elements arrayed as shown by the dashed line in FIG. 1A is increased. The main reflector is elongated in conjunction with this. Therefore, when the antenna gain is the same, it is possible to compare air resistance by the width W of the main reflector in the short-edge direction thereof.

Compared to the prior art that uses two metal conductors, directional characteristics in the horizontal plane can be obtained that are suitable for a six-sector wireless zone.

In the description of this embodiment, the first and second metal conductors were described as being cylindrical, but these conductors may also have a square columnar shape.

The reflector was also composed of a rectangular plate-shaped main reflector and side reflectors in this description, but the side beam and back lobe levels can also be minimized while narrowing the HPBW by using first and second metal conductors in a structure that has only a main reflector and no side reflectors.

What is claimed is:

1. An antenna that uses four metal conductors, comprising:

a rectangular reflector;

first and second dipole antennae disposed in front of said reflector and aligned parallel to the long edge of the reflector and to each other;

a pair of rod-shaped first metal conductors arranged parallel to said first and second dipole antennae and separated from said dipole antennae by a distance $X_1$ to the outside in the direction parallel to the short edge of the reflector, and separated by a distance $Y_1$ in the direction perpendicular to the reflector; and a pair of rod-shaped second metal conductors arranged parallel to said first and second dipole antennae and separated from said dipole antennae by a distance $X_2$ greater than distance $X_1$ to the outside with respect to each other in the direction parallel to the short edge of said reflector, and separated by a distance $Y_2$ in the direction perpendicular to said reflector.

* * * * *